US009499364B2

(12) United States Patent
Carmichael et al.

(10) Patent No.: US 9,499,364 B2
(45) Date of Patent: Nov. 22, 2016

(54) METHOD OF HANDLING A WEB-LIKE LABELLING MATERIAL IN AN AUTOMATED LABELLING PROCESS, LABELLING MACHINE VACUUM DRUM AND LABELLING MACHINE

(71) Applicant: Sidel S.p.A., Parma (IT)

(72) Inventors: James Carmichael, Parma (IT); Gabriele Giuliani, Parma (IT)

(73) Assignee: SIDEL S.P.A., Parma (IT)

( * ) Notice: Subject to any disclaimer, the term of this patent is extended or adjusted under 35 U.S.C. 154(b) by 6 days.

(21) Appl. No.: 14/448,063

(22) Filed: Jul. 31, 2014

(65) Prior Publication Data

US 2015/0035228 A1 Feb. 5, 2015

(30) Foreign Application Priority Data

Aug. 2, 2013 (EP) ..... 13179196

(51) Int. Cl.
*B65H 5/02* (2006.01)
*B65H 5/22* (2006.01)
(Continued)

(52) U.S. Cl.
CPC ..... *B65H 5/222* (2013.01); *B65C 3/08* (2013.01); *B65C 9/1819* (2013.01); *B65C 9/40* (2013.01); *B65C 9/42* (2013.01); *Y10T 156/1062* (2015.01); *Y10T 156/17* (2015.01)

(58) Field of Classification Search
CPC ..... B65H 3/08; B65H 3/10; B65H 3/20; B65H 5/22; B65H 5/222; B65H 5/226; B65H 2404/40; B65H 2404/41; B65H 2404/4121; B65H 2406/15; B65H 2406/33; B65H 2406/36; B65H 2406/361; B65H 2406/365; B65H 2406/42; B65H 2406/422; B65H 2406/423; B65H 3/0692; B65H 5/00; B65H 2406/30; B65H 3/0615; B65H 3/12; B65H 3/36; B65H 3/42; B65H 3/0891; B65H 3/14; B65H 3/48; B65H 5/02; B65H 5/028; B65H 5/06; B65H 5/18; B65H 5/224
USPC ..... 271/11, 90, 94, 96, 97, 98, 275, 276
See application file for complete search history.

(56) References Cited

U.S. PATENT DOCUMENTS 5,344,519 A * 9/1994 Galchefski ..... B65C 3/12 156/444
5,855,710 A * 1/1999 Hinton ..... B65C 3/16 156/215
5,858,168 A * 1/1999 Hinton ..... B65C 3/16 156/215

FOREIGN PATENT DOCUMENTS

EP 2759484 7/2014

*Primary Examiner* — Thomas Morrison
(74) *Attorney, Agent, or Firm* — Finnegan, Henderson, Farabow, Garrett & Dunner, L.L.P.

(57) ABSTRACT

A method of handling a web-like labelling material in an automated labelling process is disclosed. The method comprises feeding a succession of labels at an input station; and conveying the labels along a circular label path from the input station to an application station located at a first angular distance from the input station as measured about an axis, at the application station means being provided for applying the labels onto respective articles fed, in succession, to the application station. The method further comprises selectively conveying the labels along the circular label path past the application station and to a discarding station located at a second angular distance from the input station as measured about an axis, the second angular distance being greater than the first angular distance.

9 Claims, 6 Drawing Sheets

(51) Int. Cl.

| | |
|---|---|
| ***B65C 3/08*** | (2006.01) |
| ***B65C 9/18*** | (2006.01) |
| ***B65C 9/42*** | (2006.01) |
| ***B65C 9/40*** | (2006.01) |

METHOD OF HANDLING A WEB-LIKE LABELLING MATERIAL IN AN AUTOMATED LABELLING PROCESS, LABELLING MACHINE VACUUM DRUM AND LABELLING MACHINE

CROSS-REFERENCE TO RELATED APPLICATIONS

This application claims the benefit of priority of European Patent Application No, 13179196.4, filed Aug. 2, 2013, which is incorporated herein by reference.

TECHNICAL FIELD

The present invention relates to a method of handling a web-like labelling material in an automated labelling process.

In particular, the invention relates to a method of handling a web-like labelling material by means of a vacuum drum of the type comprising a main body rotatable about an axis and delimited by an outer lateral surface adapted to receive the web-like labelling material cut into strips of a predetermined length, and to transfer, at a given angular position, the resulting labels to a labelling unit, the outer lateral surface comprising ports fluidly connectable to either a source of vacuum or a source of pressurised air.

Furthermore, the invention relates to a vacuum drum group for handling a web-like labelling material in an automated labelling process, as well as to a labelling machine including one said vacuum drum group.

BACKGROUND ART

Labelling machines are commonly used to transport, prepare and apply labels to containers, such as bottles, or articles of all sorts.

Particularly widespread is the use of glued labels, i.e. portions of a labelling material that are cut from a web at appropriate lengths, upon which glue is applied by gluing means (such as a gluing roller, spray and injector systems or the like) and which, finally, are transferred and applied, onto respective containers or articles.

Automated implementation of this sequence of operations emails, in practice, retaining—by suction—the strips of labelling material on the outer lateral surface of a vacuum drum, for glue application and for delivery to an output station.

A conventional vacuum drum group for use in this context comprises a vacuum drum mounted, in a rotatable manner about its axis, on a stationary distributor member.

The vacuum drum has an approximately cylindrical lobed configuration and is adapted to receive a succession of strips of labelling material at an input station and, after rotating about its axis by a given angle, to release the strips of labelling material at an output station, so that said strips can be applied to respective articles or containers.

The stationary distributor member has first air passages connected to a vacuum source; the vacuum drum is in turn provided with second air passages, which are configured to communicate with the first air passages at certain angular positions of the drum as it rotates about its axis, and end into a plurality of vacuum ports formed through an outer lateral surface of the drum for receiving the labels.

More particularly, vacuum ports are formed in a plurality of damping pads and intermediate sections which, together, define the outer lateral surface of the vacuum drum, as has been described e.g. in co-pending European patent application 13425015.8 in the name of the same applicant.

When being retained by the vacuum drum, a label shall typically have the leading end held on one pad, the trailing end held on another pad and the remaining (intermediate) part held on a section of the drum outer lateral surface comprised between the two mentioned pads.

The afore-mentioned co-pending European patent application further describes, in greater detail, how pads and intermediate sections are arranged about the periphery of a vacuum drum and how, in use, they cooperate with a strip of labelling material as it is cut off and received onto the outer lateral surface of the vacuum drum and, immediately thereafter, brought in coupling arrangement with gluing means, to finally be released off the outer lateral surface of the vacuum drum and delivered to a container. In practice, the distance between two pads is substantially equal to the length of the strip of labelling material to be processed as measured along the circumference of the drum.

Furthermore, the height of the drum is approximately equal to the height of the strip of labelling material to be processed as measured parallel to the rotation axis of the drum. In practice, the height of the drum is slightly less than the height of the strip of labelling material (label) to be processed, so that the upper and lower edges of the label overhang the vacuum drum by a few millimeters, which helps prevent glue from contaminating the vacuum drum surface.

Roll-feed labelling machines are known to be capable of operating with great efficiency and at very high speed, which is ideal for meeting the continuously increasing through-puts required on the market. In order to do so, however, roll-feed labelling machines need to rely on a continuous, gap-less supply of containers at the output station when operating at full speed. Furthermore, ramp-up mid ramp-down times are needed when starting up and shutting down, respectively, operation of the labelling machine.

These limitations can cause problems, in particular when a labelling machine is designed to be blocked into a group of processing machines each implementing a different operation in the packaging line, e.g. blow-moulding, filling and capping machines.

Those machines are constantly run at their maximum speed, whereas the labelling machine generally operates at a speed that may be lower than or, at most, as high as that of those other machines in the group.

Production constraints may generate gaps in the succession of containers reaching the labelling machine and/or impose working with an intermittent feed of the containers within the same block (e.g. due to interventions of an operator for quality checks, or the like).

This is greatly undesirable because it may easily cause a number of containers to be labelled incorrectly or labels to be released when no container is being delivered to receive it. This may entail, aside from a minor loss of labelling material, the need to discard labelled products which do not satisfy certain production requirements. On top of that, the possibility that glued labels accumulate in parts of a machine where their presence is not expected represents an even more undesirable drawback, that can be detrimental to the quality of the overall label application process and, in even more general terms, can hinder proper operation of the labelling machine as a whole.

Furthermore, while capable of operating steadily at very high speed, roll-feed labelling machines clearly need to be started up from an idle condition to reach that steady operation mode, just as they need to be shut down to go back to that idle condition. Therefore, their speed needing to be ramped up/down, problems of operative coupling/timing with the other processing machines in the group often occur. A preliminary phase of rather fine tuning of relative speeds is typically required, and this typically results in labelling material being incorrectly transferred onto containers.

The loss of some labelling material at this stage does not represent a major issue from an economic point of view. However, the need to subject a labelling machine to a major ramp acceleration or deceleration during start-up and shut down, respectively, can overstress the machine and even lead to a highly undesirable process crash.

Therefore, the need is felt in the art for a method of handling a web-like labelling material in an automated labelling process whereby it is possible to overcome at least partly the drawbacks outlined above.

In particular, the need, is felt in the art for a method of handling a web-like labelling material in an automated labelling process that makes it possible to reduce the amount of labelling material that goes to waste during start-up and shut-down of the labelling machine, as well as when, during normal operations, gaps are formed in the succession of containers to be labelled, e.g. because of issues in any other processing machine operatively associated with the labelling machine—as is generally the case in the packaging process of a pourable product.

It is, therefore, an object of the present invention to provide a method of handling a web-like labelling material in an automated labelling process, which makes it possible to meet said need in a simple and cost-effective manner.

Furthermore, it is an object of the present invention to provide a labelling machine vacuum drum for handling, accordingly, a web-like labelling material in an automated labelling process.

DISCLOSURE OF THE INVENTION

The above said object is achieved by the present invention, as it relates to a method of handling a web-like labelling material in an automated labelling process according to claim 1. Furthermore, a labelling machine vacuum drum group is provided, according to claim 7.

Finally, according to the invention there is provided a labelling machine according to claim 9.

BRIEF DESCRIPTION OF THE DRAWINGS

A preferred, embodiment is hereinafter disclosed for a better understanding of the present invention, by mere way of non-limitative example and with reference to the accompanying drawings, in which.

BEST MODE FOR CARRYING OUT THE INVENTION

Figure 2:
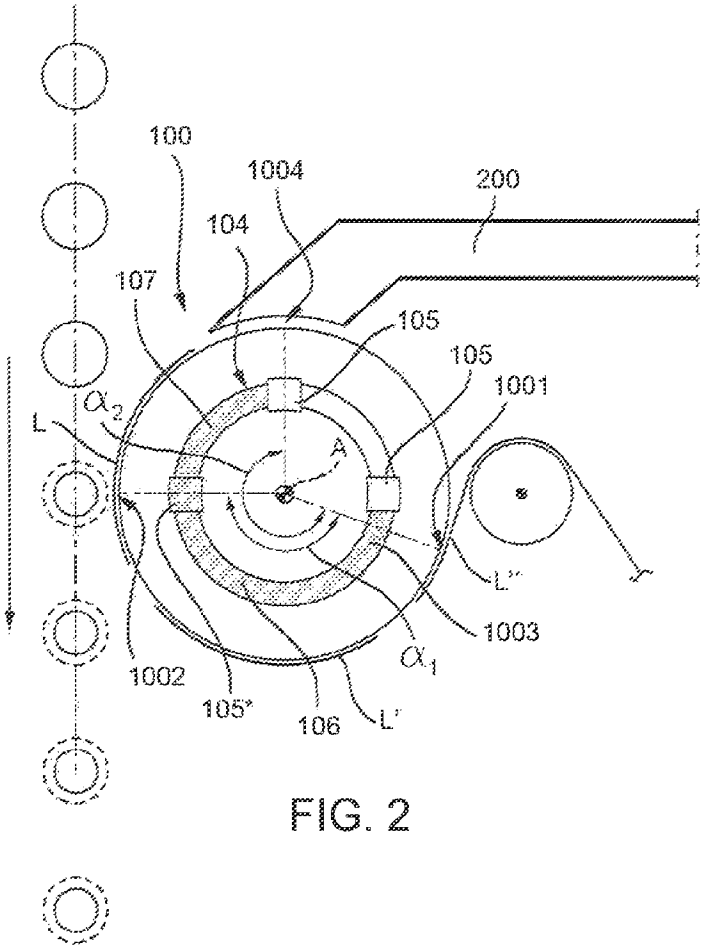
FIGS. 1 to 5 shows a simplified, schematic top view of a labelling machine handling a web-like labelling material in an automated labelling process according to the method of the invention in different, consecutive moments, where the speed of the labelling machine is progressively increased, until a steady-state operating speed is reached.

Number 100 in FIGS. 1 to 6 indicates, as a whole, a vacuum drum distributor device (of which only parts are shown in detail) upon which a vacuum drum can be mounted for operative coupling in a labelling machine, wherein the vacuum drum is adapted to handle and transfer strips L of a labelling material (i.e. labels) along an arc-shaped (e.g. substantially circular) path about a vertical axis A towards labelling means (of known type, and therefore not illustrated here) for applying labels to respective articles C, such as containers filled or to be filled with a pourable product.

In particular, the vacuum drum is of the type adapted to receive a succession of labels L at an input station 1001 and to transfer said labels L to a labelling unit at an application station 1002, located at a given first angular distance $\alpha_1$ from input station 1001 as measured about axis A. At application station 1002, labels L are applied onto respective articles C.

Input station 1001 may generally be considered to be defined by the position, with respect to axis A, of the cutting unit by which strips of labelling material are cut to a predetermined length off the web being fed off the reel, so as to form labels L.

A typical cutting unit comprises a rotary blade and a stationary blade—which, is also often referred to as the counterblade—which are arranged adjacent to vacuum drum. In use, the web of labelling material is advanced between the stationary and the rotary blade of the cutting unit, the leading edge of the web being picked, by suction, by the rotating vacuum drum. The vacuum drum is typically driven to rotate at a speed higher than the speed at which the labelling material web is advanced along the label path, whereby the vacuum drum applies a pulling force on the leading edge of the web. When, upon rotation, the rotary blade becomes contraposed to the stationary blade, a strip can be cut off the labelling material web.

By appropriately setting the speed at which the labelling material web is fed towards the vacuum drum and the rotational speed of the drum bearing the rotary blade of the cutting unit (cutting unit drum), the length of the strips can conveniently be adjusted. At the same time, the rotational speed of the vacuum drum is geared to the rotational speed of the cutting unit drum as a function of the number of label positions that designed on the vacuum drum. Positional synchronising between cutting unit drum and vacuum drum, is critical for obtaining a correct positioning of the cut labels on the vacuum drum.

Once picked by the vacuum drum and adhering to the lateral surface thereof by virtue of the action of suitable suction means, the newly-cut labels L are advanced along the label path which is locally defined by the periphery of the vacuum drum.

Prior to reaching application station 1002, i.e. prior to covering in full angular distance $\alpha_1$ at which the vacuum drum is operatively coupled with means conveying the containers to be labelled (which may consist of a carousel, or of a linear conveyor belt), the newly-cut labels L reach a gluing station, at which the vacuum drum is operatively coupled with a gluing unit (not shown). Typically, the gluing unit comprises a glue roller adapted to contact a label L carried by the vacuum arum, so that a glue pattern is applied onto its surface.

For the vacuum drum to handle labels L according to the process outlined above, proper tuning and timing of the fluidic communication/disconnection between the outer lateral surface of the vacuum drum, which matter-of-factly cooperates with labels L, with suitable suction means is paramount.

To this purpose, vacuum drum distributor device 100 comprises a stationary body provided with fluidic passages, each, of which is connected to either a vacuum source (not shown) or to a source of pressurized air (not shown). Vacuum drum distributor device 100 is designed to superiorly receive and operatively couple with a vacuum drum, which is rotatable about axis A and is provided with ducts communicating, at one end, with the fluidic passages of distributor device 100 whenever the vacuum drum, whilst rotating about axis A, occupies given angular positions (as shall be explained in greater detail in the following) and, at the another end, with a plurality of side ports opening through the outer lateral surface of the drum. A vacuum drum, of this type is described and illustrated e.g. in co-pending European patent application 13425015.8 in the name of the same Applicant.

In particular, this type of vacuum drum comprises a lower plate which is arranged in contact with an upper horizontal surface of stationary body of distributor device 100, and which is provided with apertures defining the inlets of the ducts referred to above, and which come into fluidic communication with the fluidic passages in distributor device 100 when the vacuum drum occupies certain angular positions.

In practice, when fluidic communication is established between the vacuum source and at least one of the ducts of the vacuum drum, air is suctioned from the corresponding side ports, so as to produce an attractive force on a label L, whereby said label L is held at least partly against the outer lateral surface of the drum and conveyed, accordingly, along a portion of the arc-shaped label path defined by the very periphery of the vacuum drum.

FIGS. 1 to 5 provide a simplified illustration of how fluidic communication is established between the vacuum source and the side ports in the outer lateral surface of the vacuum drum during operation according to the method of the present invention.

Figure 5:
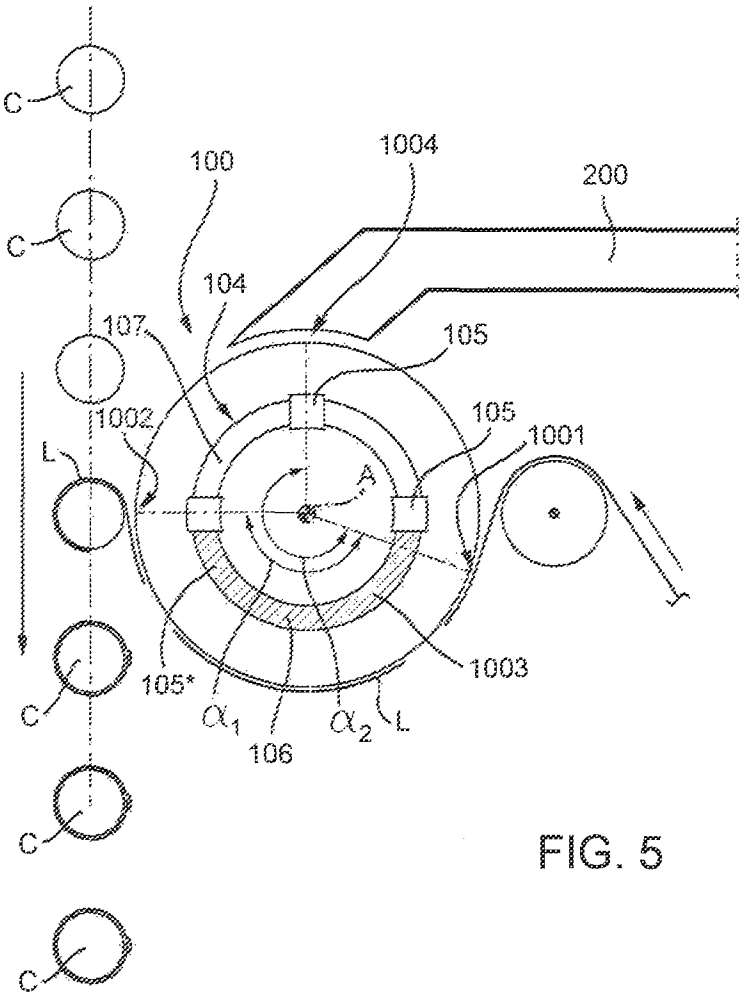

FIG. 5 illustrates operation under normal production conditions, i.e. where a gapless succession of containers to be labelled is delivered at constant speed at the application station 1002, labels L being delivered by the vacuum drum at substantially the same speed to the very same application station 1002 for being transferred onto respective containers.

The strips of labelling material cut to form labels L are picked at input station 1001 and held against the outer lateral surface of the vacuum drum substantially over a first angular distance $\alpha_1$ which corresponds to the angular distance separating input station 1001 and application station 1002.

To this purpose, fluidic communication between the outer lateral surface of the vacuum drum and a vacuum source is produced over a substantially equivalent angular distance $\alpha_1$. In FIG. 5, this is shown in a simplified manner by representing a single channel 1003 of vacuum drum distributor device 100, a portion of which (dashed area in FIG. 5) extending substantially from input station 1001 to application station 1002 over an angular distance $\alpha_1$ and being put in fluidic communication with the vacuum source. Further details as to how this may be achieved in practice, as well as additional information concerning what features of the distributor device are involved in the implementation of this mechanism, shall be given below.

Thus, under normal production conditions, each label L in the succession of labels fed to the vacuum drum is then released at the application station, by interrupting the communication of the relevant side ports with the vacuum source. Preferably, at least a portion of said side ports are put in fluidic communication with the source of pressurized air, so as to positively initiate the detachment of label L off the lateral outer surface of the vacuum drum, with a view to facilitating the transfer and wrapping of the label L about the respective article (container).

Advantageously, the strips of labelling material cut to form labels L picked at input station 1001 may selectively be held against the outer lateral surface of the vacuum drum substantially over a second angular distance $\alpha_2$ greater than the first angular distance $\alpha_1$ and delivered at a discarding station 1004 arranged downstream, with respect to a direction of advancement of labels L along the label path. In other words, said second angular distance $\alpha_2$ corresponds roughly to the angular distance separating input station 1001 and discarding station 1004.

To this purpose, fluidic communication between the outer lateral surface of the vacuum drum and a vacuum source can selectively be produced over a substantially equivalent angular distance $\alpha_2$. FIGS. 1 to 4, this is shown in a simplified manner by representing a single channel of vacuum drum distributor device 100, a portion of said channel (dotted area in FIGS. 1 to 4) extending substantially from input station 1001 to discarding station 1004 over second angular distance $\alpha_2$ and being put in fluidic communication with the vacuum source. A detailed description of how this may be achieved in practice, as well as of what features of the distributor device are involved in the implementation of this mechanism, shall also be provided below.

Discarding station 1004 comprises means 200 for extracting/ejecting labels L off the circular path defined by the periphery of the vacuum drum, so that they can be disposed of.

Furthermore, vacuum drum distributor device 100 comprises means (not illustrated) for selectively switching between a first operative configuration where fluidic communication between a distribution channel of vacuum drum distributor device 100 and the vacuum source is established over the first angular distance $\alpha_1$ and a second operative configuration where fluidic communication between said distribution channel of vacuum drum distributor device 100 and the vacuum source is established over second angular distance an greater than the first angular distance $\alpha_1$.

Thus, whenever abnormal operating conditions occur (e.g. during start-up or shut-down of the labelling machine, or wherever a gap is present in the succession of containers being fed towards the application unit), a label L shall not be released at application station 1002 as it would be under normal operating conditions, but it is retained against the outer lateral surface of the vacuum drum further on as the vacuum drum rotates about awls A, until label L reaches discarding station 1004, at which position communication of the relevant side ports with the vacuum source is interrupted.

Preferably, when the leading edge of label h has covered second angular distance $\alpha_2$, at least a portion of the side ports of the outer lateral surface of the vacuum, drum are put in fluidic communication with the source of pressurized air, so as to positively initiate the detachment of label L off the lateral outer surface of the vacuum drum, with a view to facilitating the extraction thereof on the part of ejecting/extracting means 200 of discarding station.

Figure 1:
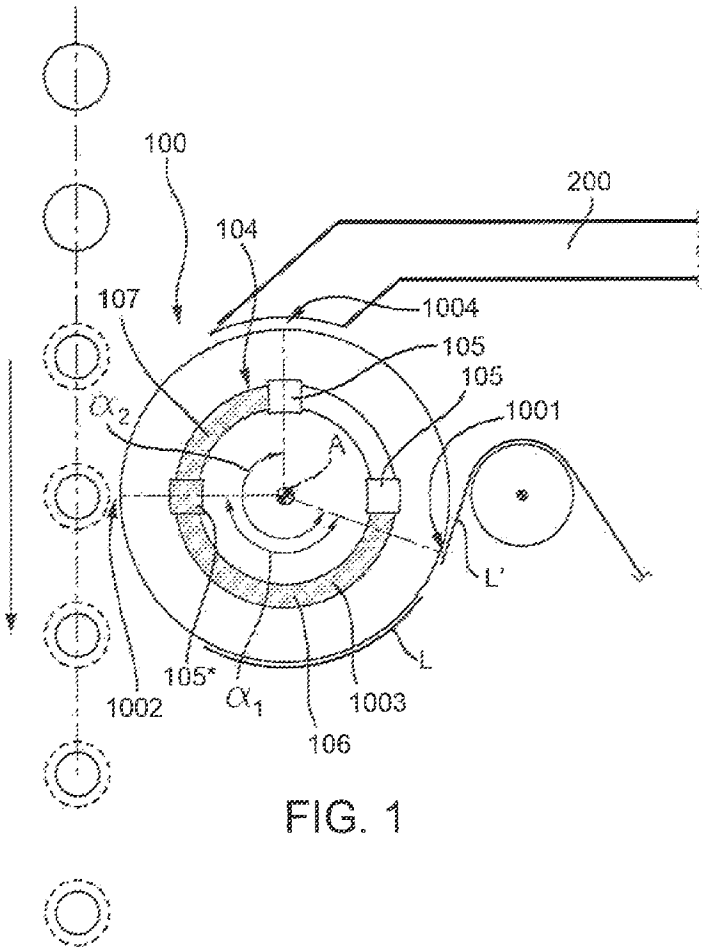
Figure 3:
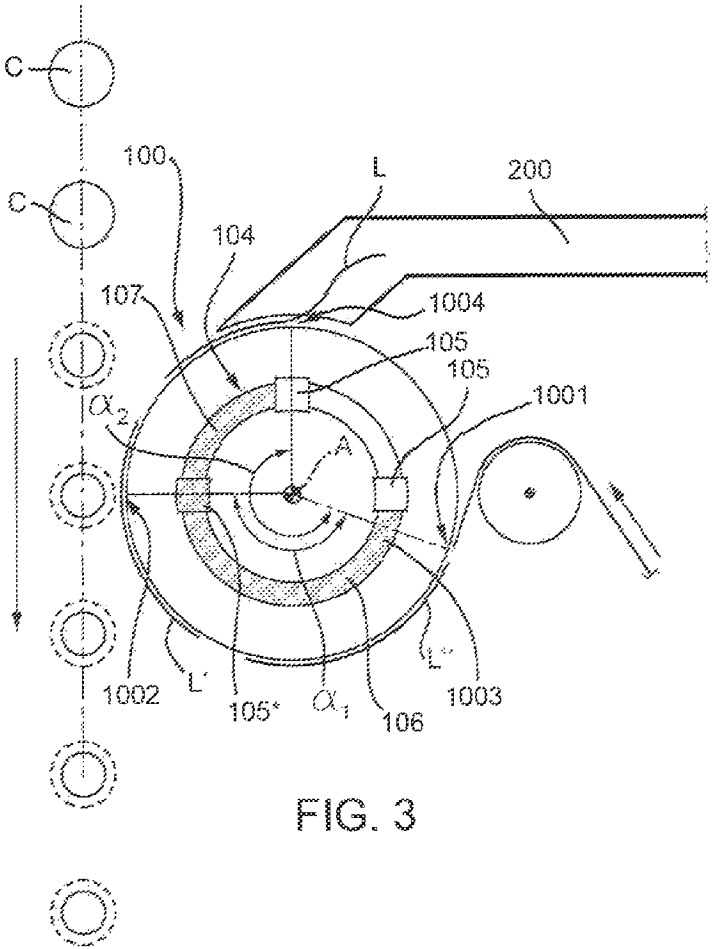

FIGS. 1 to 4 show operation of the vacuum drum in four consecutive moments during start-up of the labelling machine (no container is being delivered to the application station, yet). In greater detail:

FIG. 1 shows a first label L having already been transferred onto the outer lateral surface of the vacuum drum, while the consecutive, second label L' in the succession being fed to the vacuum drum is about to be cut off the web of labelling material at input station 1001;

FIG. 2 shows how the first label L is conveyed past the first angular distance $\alpha_1$, i.e. past the application station 1002, on towards discarding station 1003, whereas the second label L' is advancing along the label path and a consecutive, third label L" is about to be cat off the web of labelling material at input station 1001;

FIG. 3 shows how the first label L has reached discarding station 1003 where it is released off the outer lateral surface of the vacuum drum substantially after covering the second angular distance $\alpha_2$, and it is picked up by extraction means 200; in the meantime the next labels L' and L" have been progressing about the label path following in the steps of the first label L.

In practice, in FIGS. 1 to 3, vacuum drum distributor device 100 is shown in its second operative configuration where fluidic communication between the distribution channel of vacuum drum distributor device 100 and the vacuum source is established over second angular distance $\alpha_2$.

Figure 4:
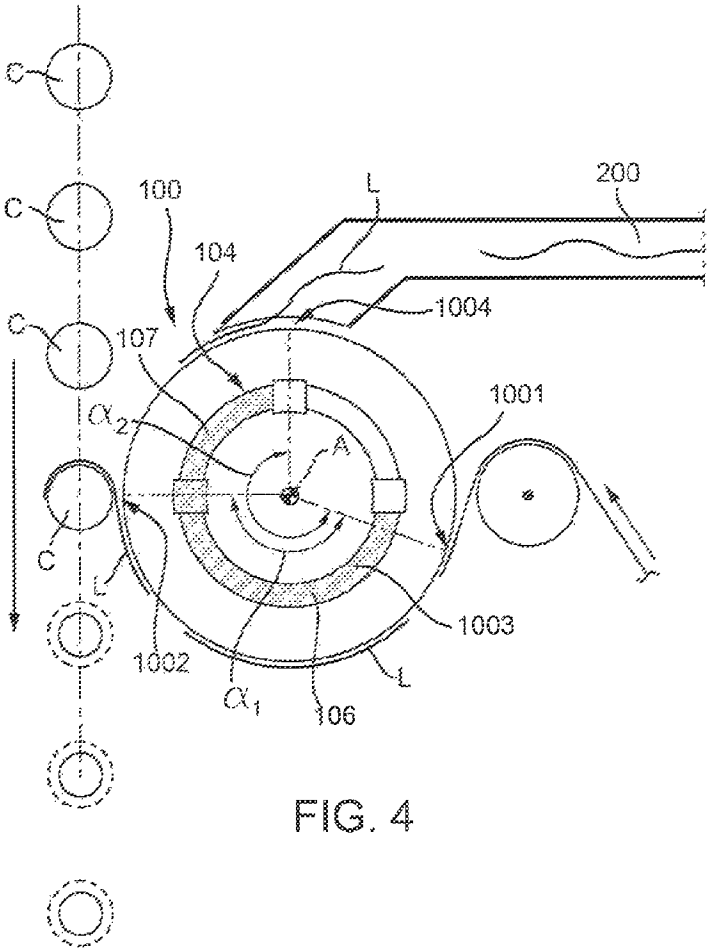

On the other hand, FIG. 4 shows how, in proper timing with the arrival of a first container C at application station 1002, vacuum drum distributor device 100 is being switched into its first operative configuration where fluidic communication between the distribution channel of vacuum drum distributor device 100 and the vacuum source is established only over first angular distance $\alpha_1$. Accordingly, the release of the next label L at application station 1002 is properly timed with the arrival of a container to be labelled.

Advantageously, the means for selectively switching vacuum drum, distributor device 100 between the first and second operative configurations, i.e. for varying the angular distance over which fluidic communication between a distribution channel of vacuum drum distributor device 100 and the vacuum source is established, may be operatively connected with a control unit, which is, in turn, operatively connected with one or more sensor means adapted to detect at least one abnormal operating condition. By way of example, the control unit may be advantageously configured, to switch vacuum drum distributor device 100 from the first to the second, operative configuration upon detection of a gap in the succession of containers C being fed to the labelling machine, or upon detection of a predetermined difference in speed between the peripheral speed of the vacuum drum, (which corresponds to the speed at which labels L advance towards application station 1002) and the speed at which the container conveying means advance towards application station. It shall be understood that this condition of speed difference typically identifies a start-up/shut-down phase.

Figure 6A:
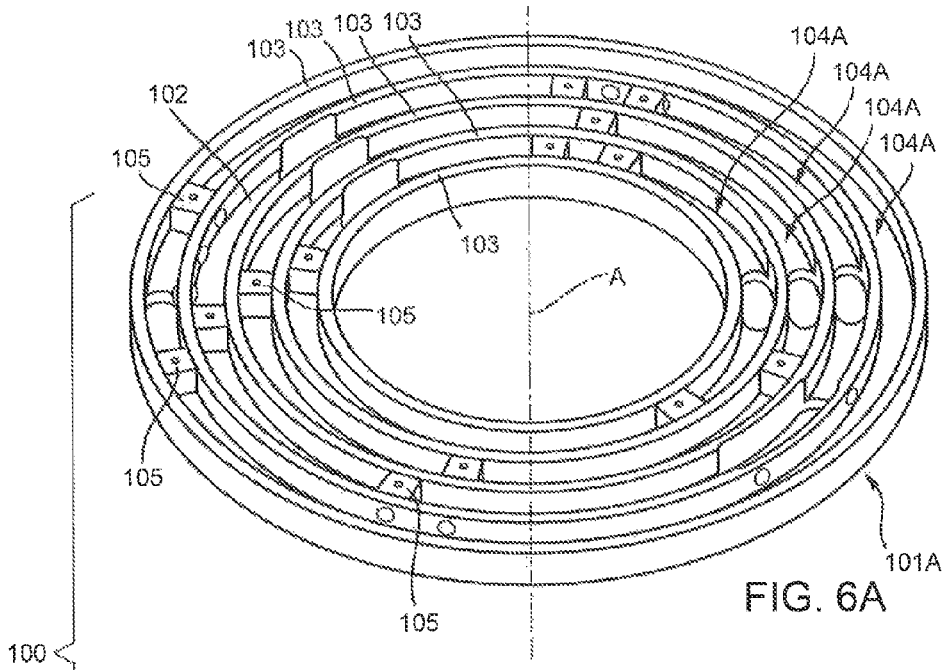
FIGS. 6A and 6B show schematic perspective views of parts of a distributor device of a vacuum drum adapted to handle a web-like labelling material in an automated labelling process according to the present invention.
Figure 6B:
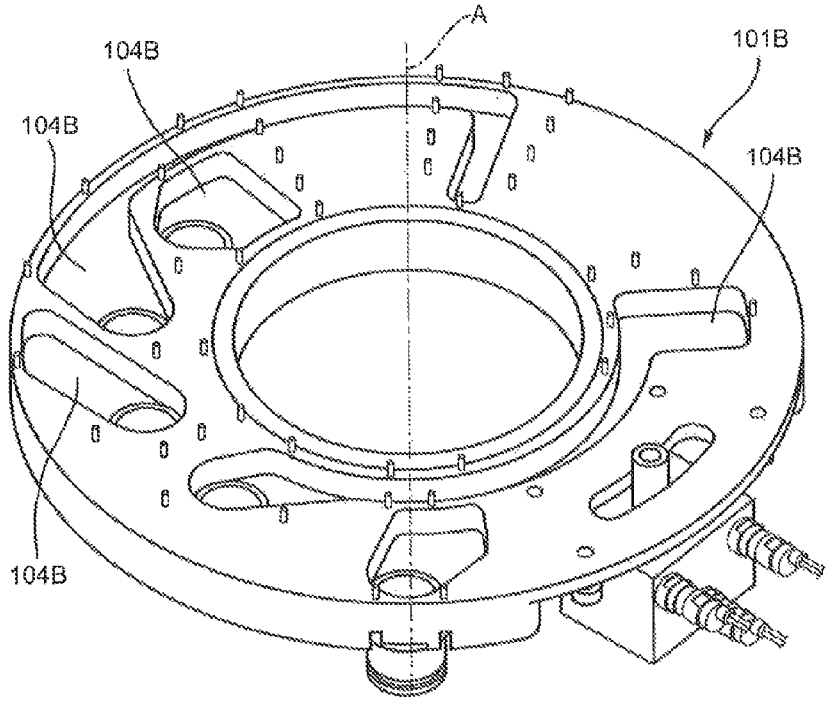

As illustrated in FIGS. 6A and 6B, distributor device 100 comprises a stationary member including an upper annular member 101A and a bottom annular member 101B superimposed to one another and both coaxial with axis A. In use, upper annular member 101A and a bottom annular member 101B are arranged coaxial with the lower plate of the vacuum drum, which also has an annular shape, so as to define a common central through hole.

Stationary member is supported in fixed position in a known and not shown manner, and comprises a lower portion coupled by means of suitable fittings to the vacuum source and, if present, to the source of pressurized air.

Annular upper member 101A comprises a horizontal bottom wall 102 and a plurality of vertical walls 103, which project upwardly from bottom wall 102. Together, walls 102 and 103 define at least two (and preferably three or four) concentric circular grooves 104A, which are continuous about axis A and each of which has a constant width in the radial direction.

Bottom wall 102 has a plurality of vertical through holes adapted to put grooves 104A in fluidic communication with chambers 104B defined in bottom annular member 101B arranged therebelow and which are, in turn, in fluidic communication with the vacuum source or the source of pressurised air.

Blocks 105 are housed in grooves 104 to divide grooves 104 into distinct arc-shaped groove portions in airtight manner. Arc-shaped, groove portions define the passages in the distributor device as described above, and are open at the top, in order to communicate with the ducts in the vacuum drum.

Blocks 105 are arc-shaped and have the same width and the same radius of curvature of the corresponding grooves 104, so that they can be moved along grooves 104 during assembly of stationary member 101 of distributor device 100, in order to adjust and set their desired mutual positions. Thus, the position and/or the length of the arc-shaped groove portions 104 can be selected and adjusted as a function of the type of labelling machine, as a function of its configuration, and as a function of the length of the labels to be handled and applied.

Figure 7:
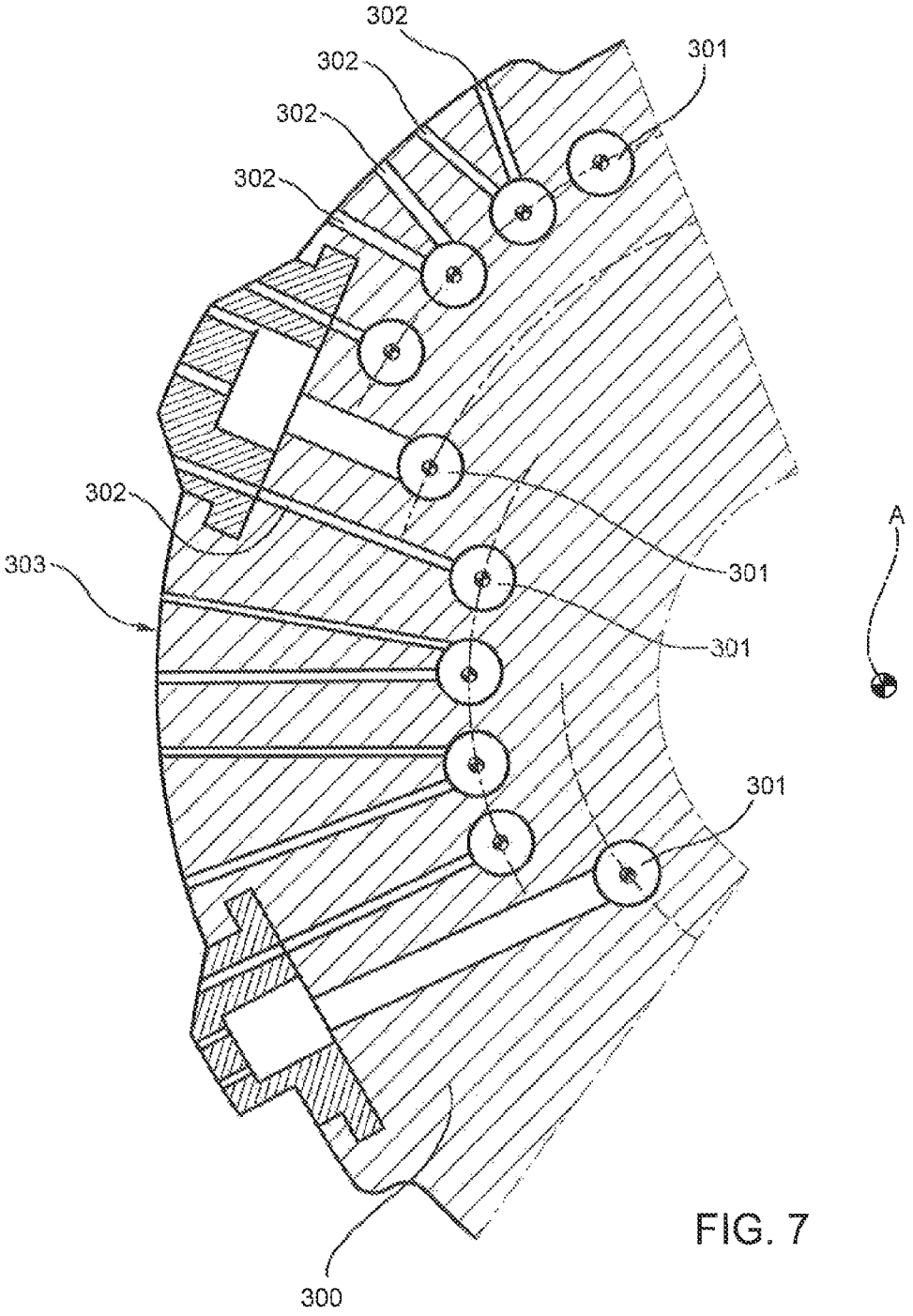
FIG. 7 shows a detail of a schematic section of the vacuum drum operatively coupled with the distributor device of FIGS. 6A and 6B.

FIG. 7 shows a detail of a section of vacuum drum 300 which is operatively coupled with and arranged coaxial wish and above distributor device 101 described above.

In particular, vacuum drum 300 has a plurality of bores 301 which extend axially from a bottom surface of the vacuum drum 300 and from which respective radial ducts 302 depart, which extend to the outer lateral surface 303 of vacuum drum 300.

In greater detail, subgroups of bores 301 are provided, arranged at different radial distances from axis A. In practice, different subgroups of bores 301 are arranged at a radial distance from axis A corresponding to the radial distance of a corresponding groove 104A in upper annular member 101A of distributor device 101. As a result, different grooves 104A are put in fluidic communication with different sections of outer lateral surface 303 of the vacuum drum 300.

Furthermore, depending on the geometry and mutual arrangement of chamber 104B in bottom, annular member 101B of distributor device 101, each groove 104A may be put in fluidic communication with a different vacuum source set at a respective vacuum pressure. Thus, suction forces with different intensities can be applied to different portion of the label L being held against the outer lateral surface of the vacuum drum.

One block 105* (see FIGS. 1 to 5 for a schematic representation) is housed in a groove 104A in fluidic communication with at least a portion of the cuter lateral surface of the vacuum drum (e.g. the front pad, that is the portion of outer lateral surface of the vacuum drum designed to cooperate, in use, with the leading edge of a label L) and arranged substantially at an angular distance $\alpha_1$ from, input station 1001, with respect to a direction of advancement of the labels L about rotation axis A. Thereby, a first chamber 106 is defined upstream of said block 105*, with respect to a direction of advancement of the labels L about rotation axis A, whereas a second chamber 107 is defined downstream of said one block 105*.

Advantageously, said one block 105* is selectively movable between a first (non-retracted) configuration, where it cooperates superiorly in air-tight fashion with the bottom surface of vacuum drum 303, whereby said first and second chamber 106 and 107 are not in mutual fluidic communication, only first chamber 106 being in fluidic communication with the vacuum source; and a second (retracted) configuration, where said one block 105* is lowered along a direction substantially parallel to axis A, whereby said first and second chamber 106 and 107 are in mutual fluidic communication and substantially form a single, larger chamber, the whole of which is in fluidic communication with the vacuum source.

Depending on possible alternative configurations of distributor device 101 (e.g. for connecting different portions of the lateral outer surface 303 of vacuum drum 300 with distinct vacuum sources at different pressures), one or more additional movable blocks having approximately the same structural features of block 105* and serving substantially the same purpose might be provided in one or more of the other grooves 104A of distributor device 101.

Preferably, said one block 105* may comprise ejector air jet means selectively actuatable to be active when block 105* is in its first (non-retracted) configuration and inactive when block 105* is in its second (retracted) configuration. In practice, block 105* may preferably define a conduit adapted to establish a fluidic communication between the outer lateral surface 303 of vacuum drum 300 and a source of pressurised air, when vacuum drum 300 assumes certain given angular positions as it rotates about axis A.

Thus, when block 105* is in its first configuration, a jet of pressurised air may be directed against the leading edge of the label as it reaches application station 1002, so chat its detachment off lateral outer surface 303 and its transfer onto a respective article is favoured. On the other hand, when block 105* is in its second configuration, the label is retained against outer lateral surface 303 as it travels past application station 1002, the supply of a jet of pressurised air towards the leading edge of the label being disabled.

Figure 8:
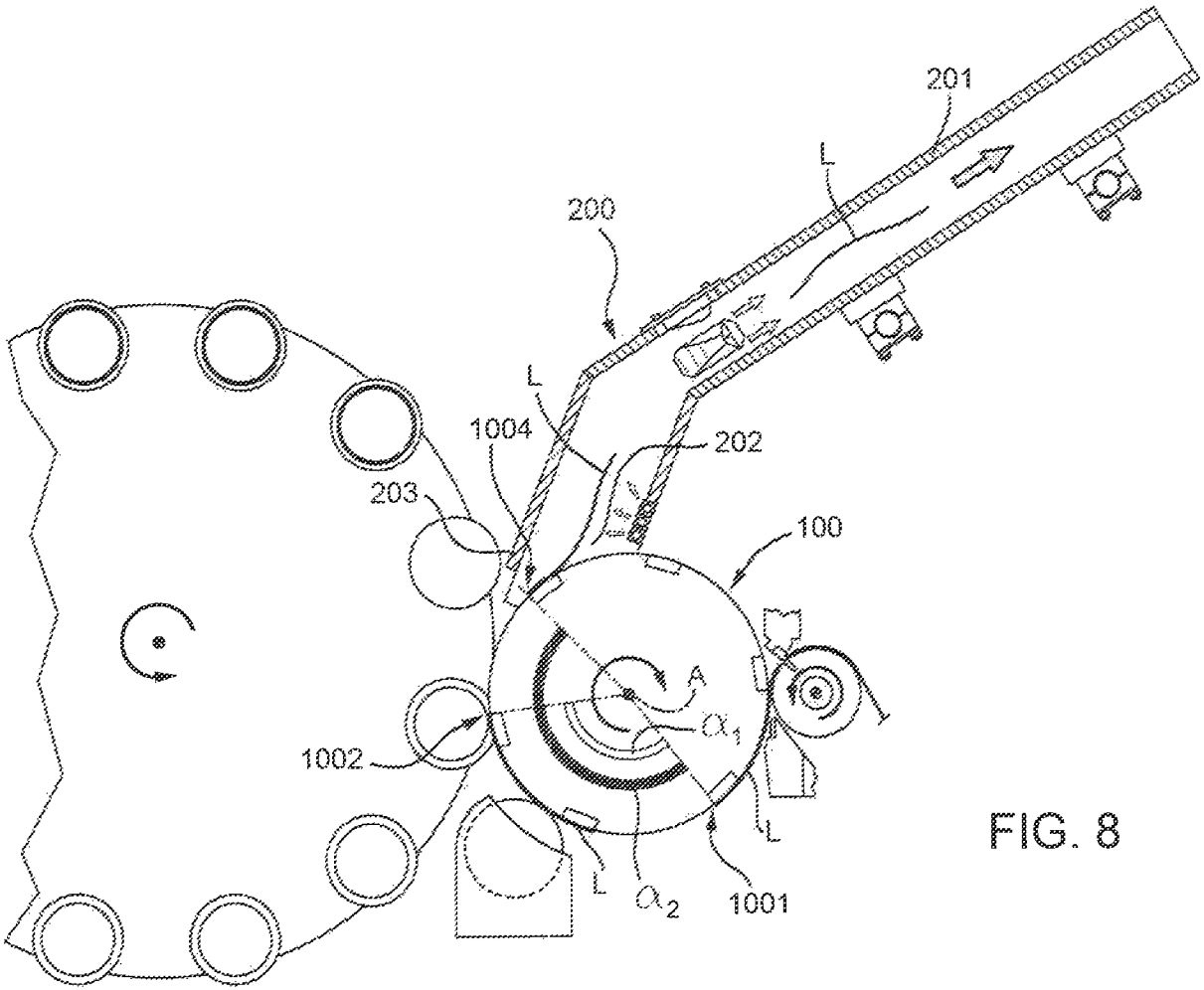
FIG. 8 shows a schematic top view of a variant of a labelling machine handling a web-like labelling material in an automated labelling process according to the method of the invention.

In FIG. 8, a variant a labelling machine handling a web-like labelling material in an automated labelling process according to the method of the invention is shown.

In particular, FIG. 8 shows, in greater detail, a possible embodiment of ejecting/extracting means 200 of discarding station 1003.

In greater detail, ejecting/extracting means 200 may comprise a tunnel 201 operatively coupled with the vacuum, drum at the discarding station 1004. Tunnel 201 may be in fluidic communication with a vacuum source. As an alternative, tunnel 201 may be a Venturi air mover, wherein internal orifices let compressed air in the direction of label extraction to create nigh flows along the tunnel, these high flows determining a suction effect at an intake of the tunnel.

As depicted in FIG. 8, tunnel 201 has a mouth 202 defining the intake of the tunnel, opening at a first end 203 and facing discarding station 1003, so that a label L being released off the outer lateral surface of the vacuum drum is immediately under the effect of the suction exerted by tunnel 201.

At the other end (not shown) tunnel 201 may be connected to a chamber where discarded labels L accumulate and are periodically removed, or it may directly lead to other disposing means.

Fluidic connection of tunnel 201 with the vacuum source may be continuously maintained, so that it is always available to perform, its function, whenever a label L reaches discarding station 1003. As an advantageous alternative, tunnel 201 may comprise means for selectively establish a fluidic connection between tunnel 201 and the vacuum source only upon detection of a given condition upstream—e.g. a gap in the succession of articles being fed to the application station, or a speed differential between the container conveyor (a star-wheel conveyor in the example illustrated in FIG. 7) and the vacuum drum outer lateral surface.

From the analysis of the features of the method of handling a web-like labelling material and of the labelling machine vacuum drum disclosed above, the advantages which can be obtained with the invention are clear.

In particular, all those situations where operating efficiency and reliability of the labelling process are typically hindered by an improper match between container feed and labelling machine speed and/or label feed can be dealt with advantageously by remarkably reducing the normally encountered drawbacks. In fact, the method and labelling machine vacuum drum of the present invention make it possible to manage any start-up or shut-down phase during which the speed of the labelling machine (namely, of the vacuum drum feeding the labels to the application station) is varied dramatically by selectively decoupling, from a functional point of view, the vacuum drum and the application station, so chat labels are not transferred off the vacuum drum outer lateral surface until a proper timing is achieved between the feed of labels and the feed of containers to be labelled. Furthermore, the method and labelling machine vacuum drum of the present invention make it possible, wherever a gap occurs in the feed of containers advancing in succession towards the application station, to selectively and temporarily de-couple functionally the vacuum drum and the application station, by having a label basically bypass the application station and proceed further towards a discarding station where it can be removed off the outer lateral surface of the vacuum drum and be disposed of.

Because the rate of occurrence of drawbacks associated with the abnormal situations mentioned above can, consequently, be greatly reduced, the overall efficiency and reliability of the whole labelling process can be significantly enhanced thanks to the method and vacuum drum of the present invention.

Finally, it is clear that modifications and variants not departing from the scope of protection of the independent claims can be made to the method and vacuum drum as disclosed and illustrated herein.

The invention claimed is:

1. A vacuum drum assembly for handling labels cut from a web-like labelling material in an automated labelling process, comprising:

a vacuum drum; and a distributor device, the vacuum drum being mounted, in a rotatable manner about a central axis, on the distributor device, wherein:

the distributor device includes first air passages in fluid communication with a vacuum source;

the vacuum drum includes second air passages extending to a plurality of ports formed in an outer lateral surface of the vacuum drum for receiving and retaining strips of the labelling material, the second air passages being configured to communicate with the first air passages at predetermined angular positions of the vacuum drum as the vacuum drum rotates about the axis, so that the strips of the labelling material are retained by the vacuum drum along a circular label path between an input station and an application station arranged at a first angular distance from the input station with respect to the axis, and so that the strips of the labelling material are released at the application station;

the distributor device includes a switching device configured to selectively switch between a first operative configuration where the fluid communication between the first air passages and the vacuum source is established over the first angular distance, and a second operative configuration where the fluid communication between the first air passages and the second air passages is established over a second angular distance greater than the first angular distance; and the switching device includes a block component housed in one of the first air passages at the first angular distance from the input station, with respect to the axis, the block component defining, in the one of the first air passages:

a first chamber upstream of the block component, with respect to a direction of advancement of the strips of the labelling material along the circular label path; and a second chamber downstream of the block component, and wherein the block component is selectively movable between:

a first position, where the block component cooperates in an air-tight fashion with a bottom surface of the vacuum drum, such that the first and second chambers are not in fluid communication, and only the first chamber is in fluid communication with the vacuum source; and a second position, where the block component is moved, such that the first and second chambers are in fluid communication with each other and in fluid communication with the vacuum source.

2. A labelling machine comprising:

a vacuum drum assembly according to claim 1; and a discarding station arranged at the second angular distance from the input station with respect to the axis, and further comprising extraction device for extracting or ejecting the strips of the labelling material off the outer lateral surface of the vacuum drum.

3. The labelling machine according to claim 2, wherein the extraction device includes a tunnel operatively coupled with the vacuum drum at the discarding station and in fluid communication with a second vacuum source.

4. The labelling machine according to claim 3, wherein the extraction device is configured to selectively establish a fluid connection between the tunnel and the second vacuum source only when the vacuum drum is in the second operative configuration.

5. A vacuum drum assembly for handling labels, comprising:

a distributor device including first air passages in fluid communication with a vacuum source;

a vacuum drum mounted on the distributor device and configured to rotate about a central axis;

wherein the vacuum drum includes second air passages extending to a plurality of ports formed in an outer lateral surface of the vacuum drum for receiving and retaining strips of the labelling material, the second air passages being configured to communicate with the first air passages at predetermined angular positions of the vacuum drum as the vacuum drum rotates about the axis, so that the strips of the labelling material are retained by the vacuum drum along a circular label path between a first station and a second station arranged at a first angular distance from the first station with respect to the axis, and so that the strips of the labelling material are released at the second station;

the distributor device includes a switching device configured to selectively switch between a first operative configuration where the fluid communication between the first air passages and the vacuum source is established over the first angular distance, and a second operative configuration where the fluid communication between the first air passages and the second air passages is established over a second angular distance greater than the first angular distance; and the switching device includes a block component housed in one of the first air passages at the first angular distance from the first station, with respect to the axis, the block component defining, in the one of the first air passages:

a first chamber upstream of the block component, with respect to a direction of advancement of the strips of the labelling material along the circular label path; and a second chamber downstream of the block component, and wherein the block component is selectively movable between:

a first position, where the block component cooperates in an air-tight fashion with a bottom surface of the vacuum drum, such that the first and second chambers are not in fluid communication, and only the first chamber is in fluid communication with the vacuum source; and a second position, such that the first and second chambers are in fluid communication with each other and in fluid communication with the vacuum source.

6. A labelling machine comprising:

a vacuum drum assembly according to claim 5; and a discarding station arranged at the second angular distance from the first station with respect to the axis, and further comprising extraction device for extracting or ejecting the strips of the labelling material off the outer lateral surface of the vacuum drum.

7. The labelling machine according to claim 6, wherein the extraction device includes a tunnel operatively coupled with the vacuum drum at the discarding station and in fluid communication with a second vacuum source.

8. The vacuum drum assembly according to claim 7, wherein the extraction device is configured to selectively establish a fluid connection between the tunnel and the second vacuum source only when the vacuum drum is in the second operative configuration.

9. The labelling machine according to claim 5, wherein the first station is an input station, and the second station is an application station.

* * * * *